US006756840B1

(12) United States Patent
Zabroda

(10) Patent No.: US 6,756,840 B1
(45) Date of Patent: Jun. 29, 2004

(54) CIRCUIT AND METHOD FOR MIRRORING CURRENT

(75) Inventor: Oleksiy Zabroda, Fair Oaks, CA (US)

(73) Assignee: STMicroelectronics, Inc., Carrollton, TX (US)

( * ) Notice: Subject to any disclaimer, the term of this patent is extended or adjusted under 35 U.S.C. 154(b) by 0 days.

(21) Appl. No.: 10/349,636

(22) Filed: Jan. 23, 2003

(51) Int. Cl.[7] ..... G05F 1/10
(52) U.S. Cl. ..... 327/538
(58) Field of Search ..... 323/312, 314, 323/315, 316; 327/382, 530, 534, 535, 537, 538, 540, 541, 543

(56) References Cited

U.S. PATENT DOCUMENTS 4,251,743 A * 2/1981 Hareyama ..... 327/538
5,650,746 A * 7/1997 Soltau ..... 327/524
6,346,804 B2 * 2/2002 Ueno et al. ..... 323/315
6,657,481 B2 * 12/2003 Rasmussen et al. ..... 327/540

* cited by examiner

*Primary Examiner*—Jeffrey Zweizig
(74) *Attorney, Agent, or Firm*—Lisa K. Jorgenson; Andre Szuwalski

(57) ABSTRACT

A method and circuit are disclosed for mirroring current. The circuit includes a reference branch through which a first current flows, and at least one mirror branch through which a second current flows that is proportional to the first current. The circuit further includes a current amplifier having an input coupled, via a capacitor, to the reference branch and an output coupled to one of the reference branch and the at least one mirror branch. The current amplifier provides, at relatively high frequencies, a current to the circuit that substantially compensates for current passing through a parasitic capacitance appearing in the circuit.

32 Claims, 3 Drawing Sheets

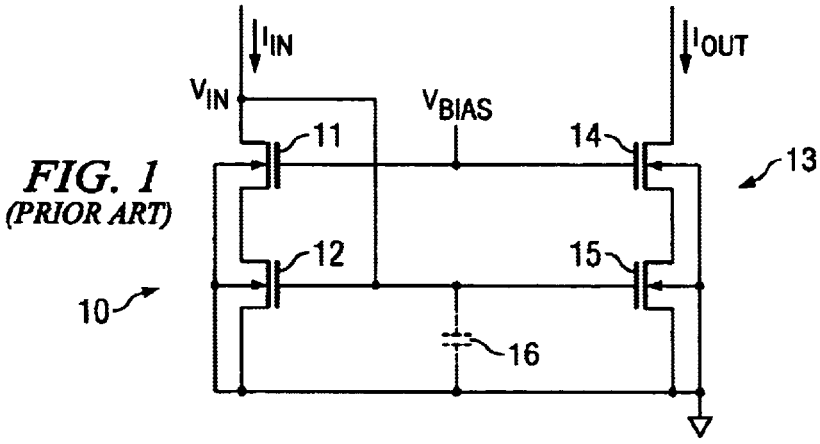
*FIG. 1*
*(PRIOR ART)*
*FIG. 2A*
*(PRIOR ART)*
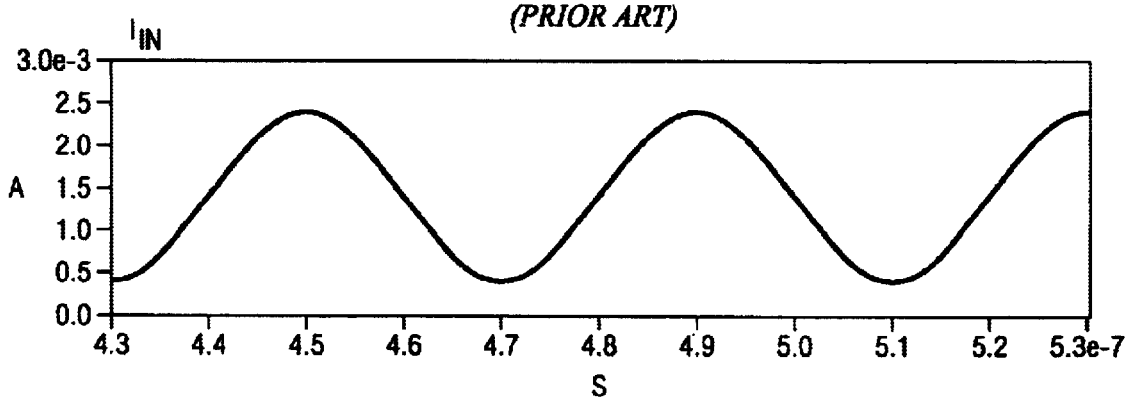
*FIG. 2B*
*(PRIOR ART)*
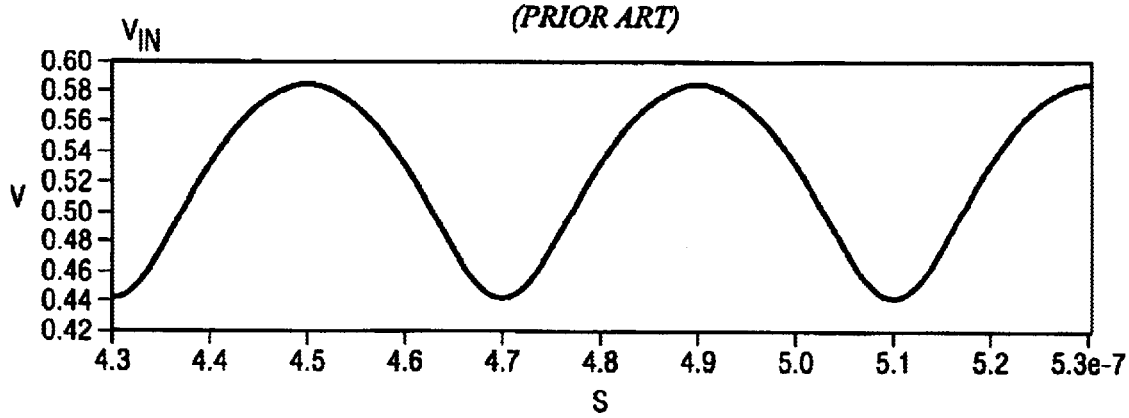

50
51
52
$I_{IN}+$
$I_{OUT}+$
$I_{OUT}-$
$I_{IN}-$
CURRENT AMPLIFIER 44
CURRENT AMPLIFIER 44
C16
C19
39
39
$V_{BIAS}$
$V_{BIAS}$
M45
M46
M56
M57
32
36
36
32
33
35
35
33
M44
M43
M55
M56
C0
37
C6
37
53
54
54
53

70
76
IN
VBIAS1
71
72
VBIAS2
OUT
74
75
73

81
82
OUT
IN
VBIAS1
VBIAS2
84
83

CIRCUIT AND METHOD FOR MIRRORING CURRENT

BACKGROUND OF THE INVENTION

1. Technical Field of the Invention

The present invention relates to current mirror circuits, and particularly to current mirrors having reduced nonlinear distortion.

2. Description of the Related Art

Current mirrors are widely used in analog integrated circuits. In general terms, current mirrors are circuits having a reference branch through which a reference current flows and at least one mirror branch through which a current flows that is proportional to the reference current flowing through the reference branch.

Efforts to improve the performance of current mirrors resulted in the creation of a wide variety of different implementations. A relatively popular current mirror implementation is the cascoded current mirror shown in FIG. 1. Reference branch 10 includes transistors 11 and 12 coupled together in cascode relation. Mirror branch 13 includes cascode connected transistors 14 and 15. The control terminals of transistors 11 and 14 are connected to a reference or bias voltage Vbias. The control terminal of transistors 12 and 15 are connected to each other and to the input of the current mirror circuit. The output current of the current mirror, Iout, passes through mirror branch 13 and is proportional to the current Iin passing through reference branch 10. The relationship between the output current Iout and input current Iin is based upon the ratio of the sizes of transistors 14 and 15 to the sizes of transistors 11 and 12. At relatively low frequencies, the current mirror of FIG. 1 exhibits relatively accurate proportionality and relatively low nonlinear distortion.

At high frequencies, however, parasitic capacitances 16 in the current mirror of FIG. 1 adversely affect the amount of nonlinear distortion. Because the transconductance of a MOS transistor is inherently nonlinear, the voltage appearing at the input of the current mirror of FIG. 1 is not linearly proportional to the input current Iin and is subject to nonlinear distortions. This may be seen with reference to FIG. 2, in which the input current and input voltage of current mirror 10 is shown. Excursions of the input voltage are greater when the input current is low. The typically high output impedance of a current source (providing input current Iin to current mirror 10) and the reference current branch do not allow the input current to be affected by the nonlinearity of the input voltage at low frequencies wherein the current flowing through parasitic capacitor 16 is negligible. At high frequencies, the current passing through parasitic capacitance 16 becomes comparable with the input current Iin. Parasitic capacitance 16 is formed from the output capacitance of the current source providing input current Iin to the current mirror, the drain capacitance of transistor 11 and the gate capacitances of transistors 12 and 15. The current passing through parasitic capacitance 16 at high frequencies adversely affects the transfer function of the current mirror. In addition, because the charge accumulated at parasitic capacitance 16 is substantially proportional to the input voltage and because the input voltage is nonlinear relative to the input current Iin, additional nonlinear distortion to the input current Iin is exhibited. These distortions are transferred to the output current Iout in mirror branch 13.

An attempt to improve the nonlinear distortion in the current mirror of FIG. 1 is shown in FIG. 3. A resistor 17 is connected to the source terminal of each transistor 12 and 15. Resistors 17 tend to make more linear the effective transconductance of the reference branch 10 and mirror branch 13 at lower frequencies. However, the effect provided by resistors 17 dwindles at higher frequencies. A transistor 18 is connected between the input of the current mirror and the gate terminals of transistors 12 and 15 so as to decouple the input capacitances of transistors 12 and 15 from the input. Though transistor 18 reduces nonlinear distortions at higher frequencies, transistor 18 reduced the headroom of reference branch 10 by a threshold voltage. For integrated circuits having lower power supply levels, such as 1.8 v, this reduction in available headroom becomes a nontrivial effect.

Based upon the foregoing, there is a need for a current mirror having reduced nonlinear distortion at high frequency operation.

SUMMARY OF THE INVENTION

Embodiments of the present invention overcome the above-identified shortcomings and satisfy a significant need for a current mirror having reduced nonlinear distortion at relatively high frequencies. Nonlinear distortions are reduced in part by employment of a current amplifier with the input coupled through a capacitor to the input of the current mirror. An output of the current amplifier is either coupled to a node in the reference branch or a node in the mirror branch of the current mirror. The current amplifier may be a noninverting amplifier (when the output thereof is coupled to the reference branch) or an inverting amplifier (when the output thereof is coupled to the mirror branch). The current amplifier serves to restore the shape of the current mirror output signal, thereby reducing the nonlinear distortion of the current mirror.

Another embodiment of the present invention is adapted for use in applications that utilize multiple current mirrors, such as in a design in which two current mirrors are employed to provide a differential current signal. In this embodiment, the output of the current amplifier of a first current mirror of a pair of current mirrors is coupled to the second current mirror of the current mirror pair, and the output of the current amplifier of the second current mirror is coupled to the first current mirror.

BRIEF DESCRIPTION OF DRAWINGS

A more complete understanding of the system and method of the present invention may be obtained by reference to the following Detailed Description when taken in conjunction with the accompanying Drawings wherein:

FIG. 1 is a schematic of conventional current mirror circuits;

FIG. 2 is a plot of input current and input voltage of the current mirror of FIG. 1.

DETAILED DESCRIPTION OF THE EXEMPLARY EMBODIMENTS

The present invention will now be described more fully hereinafter with reference to the accompanying drawings in which exemplary embodiments of the invention are shown. This invention may, however, be embodied in many different forms and should not be construed as being limited to the embodiments set forth herein. Rather, the embodiments are provided so that this disclosure will be thorough and complete, and will fully convey the scope of the invention to those skilled in the art.

Figure 3:
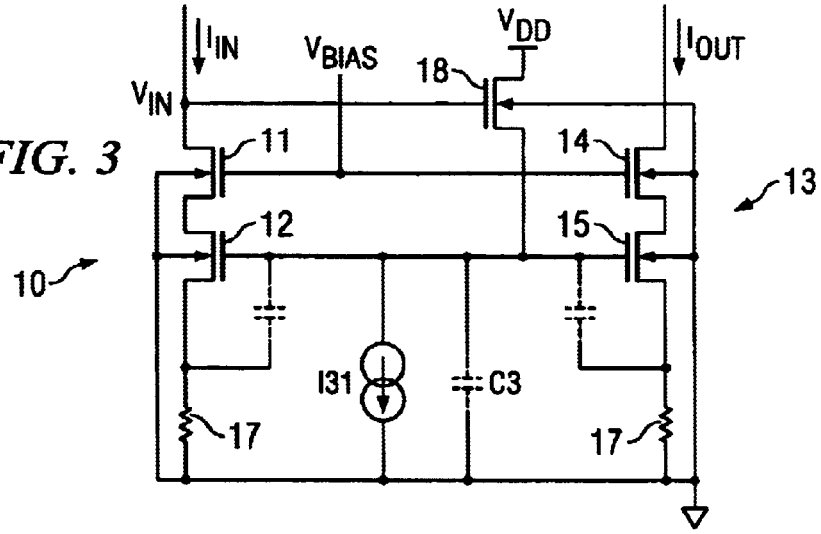
FIG. 3 is a schematic of another conventional current mirror circuit.
Figure 4:
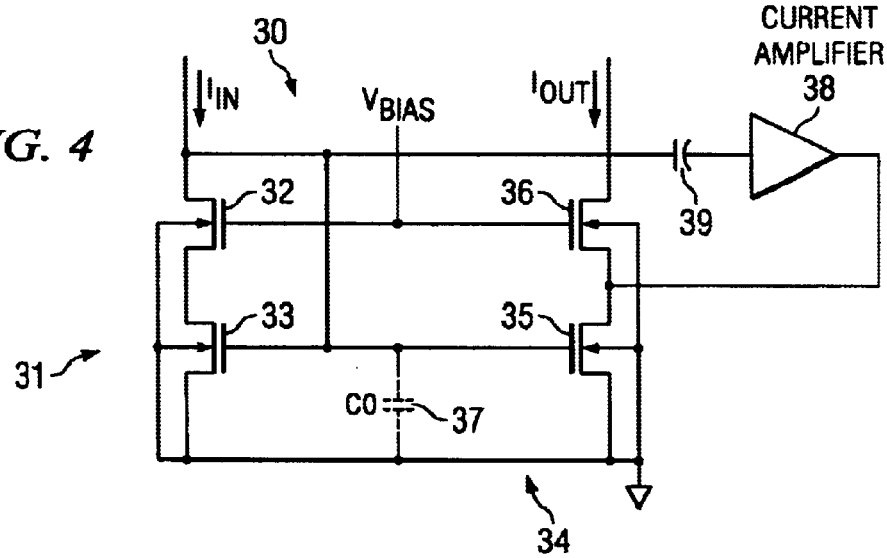
FIG. 4 is a schematic of a current mirror circuit according to an exemplary embodiment of the present invention.
Figure 5:
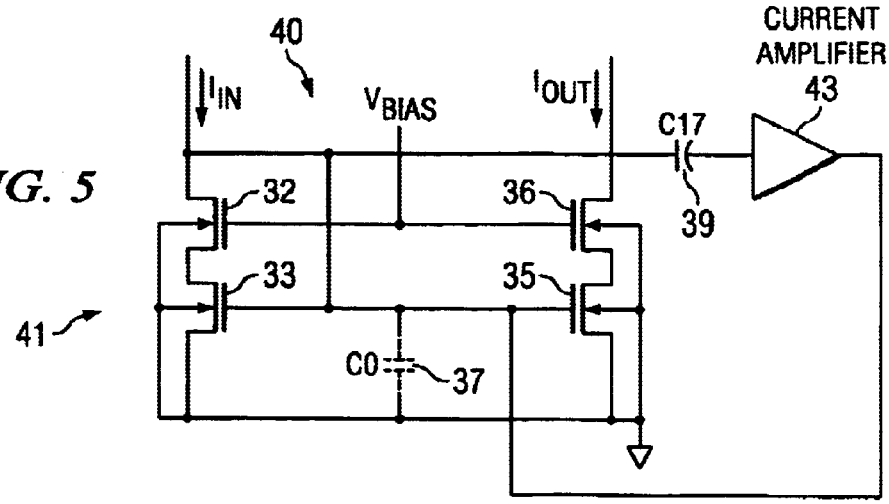
FIG. 5 is a schematic of a current mirror circuit according to a second exemplary embodiment of the present invention.
Figure 6:
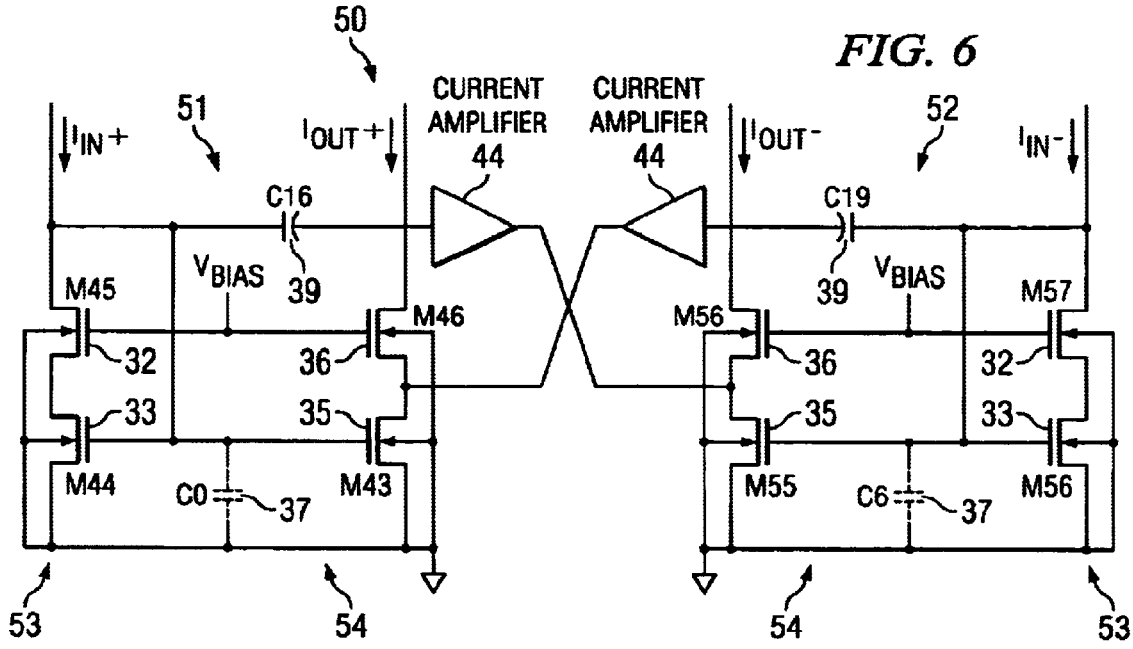
FIG. 6 is a schematic of a current mirror circuit according to a third exemplary embodiment of the present invention.

Referring to FIGS. 4–6, there is shown an improved current mirror according to exemplary embodiments of the present invention. The current mirror of the exemplary embodiments exhibit reduced nonlinear distortions at higher frequencies, relative to the nonlinear distortions observed in conventional current mirrors.

A current mirror 30 according to an exemplary embodiment of the present invention is shown in FIG. 4. Current mirror 30 may include a reference branch 31 having transistors 32 and 33. A drain terminal of transistor 32 is coupled to an input of current mirror 30 so as to receive an input current Iin provided by a current source. The gate/control terminal of transistor 32 may be biased at a reference voltage level. Transistor 33 may be coupled between transistor 32 and a second reference voltage level, such as a ground potential. The source terminal of transistor 32 may be coupled to a drain terminal of transistor 33. The source terminal of transistor 33 may be coupled to the second reference voltage level. The gate/control terminal of transistor 33 may be coupled to the input of current mirror 30 as well as the drain terminal of transistor 32. Transistors 32 and 33 pass at least a portion of input current Iin provided to current mirror 30.

Current mirror 30 may further include at least one mirror branch 34 that is coupled to reference branch 31. Mirror branch 34 may include transistors 35 and 36. Transistor 35 may include a source terminal coupled to the second reference voltage level, which in this embodiment is the ground potential; a gate terminal coupled to the gate terminal of transistor 33 and a drain terminal. Transistor 36 may include a source terminal coupled to the drain terminal of transistor 35; a gate terminal coupled to the gate terminal of transistor 32; and a drain terminal coupled to the output of current mirror 30. Transistors 35 and 36 are sized relative to the size of transistors 32 and 33 so that the output current Iout is set at the desired current level, relative to input current Iin. Sizing of transistors in the reference and mirror branches of a current mirror to achieve the desired ratio/gain of output current to input current is known in the art and will not be described in further detail for reasons of simplicity.

In order to improve (reduce) the nonlinear distortions of current mirror 30 at higher frequency operation, current mirror 30 employs a current amplifier. Referring again to FIG. 4, current amplifier 38 has an input coupled via capacitor 39 to reference branch 31 of current mirror 31 and an output coupled to the mirror branch 34 thereof. In the exemplary embodiment shown in FIG. 4, the output of current amplifier 38 is coupled to the drain terminal of transistor 34 and source terminal of transistor 36. It is understood that the output of current amplifier 38 may be coupled to other nodes in mirror branch 34. As utilized in current mirror 30 of FIG. 4, current amplifier 38 is an inverting amplifier, which sinks the output current with a positive gain in response to the sink of the input current received thereby. The implementation of current amplifier 38 will be described below.

The current flowing through capacitor 39 is directly proportional to the value of the current lost in the current mirror parasitic capacitance 37. The capacitance value of capacitor 39 and the gain of current amplifier 38 are chosen so that the current provided to mirror branch 34 at higher frequencies is substantially equal to the current lost through parasitic capacitance 37 and capacitor 39 that would have been otherwise mirrored in mirror branch 34.

It is understood that the output of current amplifier 38 may be coupled to other nodes in reference branch 31 of the current mirror 30 or to other nodes in mirror branch 34 of current mirror 30.

A current mirror 40 according to a second exemplary embodiment of the present invention is shown in FIG. 5. Current mirror 40 utilizes much of the same components found in current mirror 30 of FIG. 4. These common components found in current mirrors 30 and 40 will be assigned the same reference numbers for reasons of clarity. However, in current mirror 40, the output of current amplifier 43 is coupled to the reference branch 41 of current mirror 40, and particularly to the input of current mirror 40 and the gate terminals of transistors 33 and 35. In current mirror 40, current amplifier 43 is a noninverting amplifier which sources the output current with a positive gain in response to the sink of the input current. The capacitance of capacitor 39 and the gain of current amplifier 43 are selected so that current is provided to the input of current mirror 40 by current amplifier 43 that is substantially equal to the current passing through parasitic capacitor 37 and capacitor 39 at high frequencies.

Current mirror circuitry according to embodiments of the present invention may be employed in applications in which two current mirrors provide a differential current signal. Referring to FIG. 6, there is shown current mirror circuitry 50 according to a third exemplary embodiment of the present invention. The current mirror circuitry 50 may include a pair of current mirrors 51 and 52. Each current mirror 51, 52 may include the same transistors 32–36 with the same interconnectivity as shown in FIGS. 4 and 5. Each current mirror 51 and 52 may include a current amplifier 44 with a capacitor 39 connected to the input thereof. The input of current amplifier 44 of current mirror 51 may be coupled to reference path 53 thereof, and particularly to the input of current mirror 51. The input of current amplifier 44 of current mirror 52 may be coupled to reference path 53 thereof, and particularly to the input of current mirror 52. The output of current amplifier 44 of current mirror 51 may be coupled to current mirror 52, and particularly to mirror branch 54 thereof. The output of current amplifier 44 of current mirror 52 may be coupled to current mirror 51, and particularly to mirror branch 54 thereof. The capacitance value of capacitor 39 and the gain of current amplifier 44 of current mirror 51 are set so that the current amplifier 44 provides to current mirror 52 at high frequencies a current amount that is substantially proportional to the current that passes through parasitic capacitor 37 and 39 of current mirror 51. Likewise, the capacitance value of capacitor 39 and gain of current amplifier 44 of current mirror 52 are set so that the current amplifier 44 provides to current mirror 51 at high frequencies a current amount that is substantially proportional to the current that passed through parasitic capacitor 37 and capacitor 39 of current mirror 52. In this way, each current mirror 51, 52 is provided with a complementary current to the mirror branch 54 thereof and thereby has reduced nonlinear distortions. Current amplifiers 44 of current mirrors 51 and 52 may be implemented as inverting current amplifiers.

It is understood that the output of current amplifier 44 of current mirror 51 may be instead coupled to the reference branch 53 of current mirror 52, and the output of current amplifier 44 of current mirror 52 may be instead coupled to the reference branch 53 of current mirror 51. In this way, the current amplifiers may be implemented as non-inverting amplifiers.

It is further understood that the current mirrors described above and illustrated in FIGS. 4–6 may be implemented with transistors other than n-channel MOS transistors, such as p-channel MOS transistors or bipolar transistors. It is understood that the number of mirror branches appearing in the current mirrors of FIGS. 4–6 may vary depending upon the design in which the current mirrors are utilized and be greater than one. It is also understood that the capacitor(s) coupled to the current amplifier(s) appearing in the current mirrors of FIGS. 4–6 may be constructed of the same type of MOS transistors that form the current mirrors. It is further understood that each of the current mirrors of FIGS. 4–6 may include one or more resistive elements connected in series with the capacitor associated with the current amplifier(s).

Figure 7:
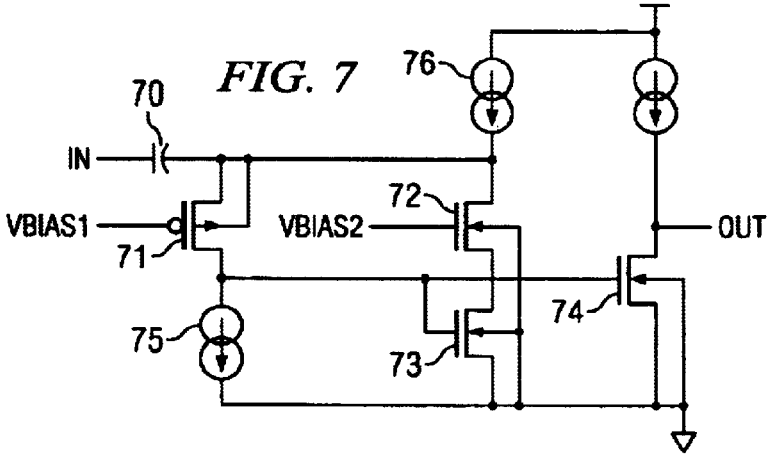
FIG. 7 is a schematic of the inverting current amplifier of FIG. 4 according to an exemplary embodiment of the present invention.

One possible implementation of an inverting current amplifier that may be utilized in the current mirror 30 of FIG. 4 is shown in FIG. 7. The current amplifier of FIG. 7 has a current mirror structure as well. The current amplifier contains the input/reference current path (transistors 72 and 73) and output/mirror current path (transistor 74). The input current path is connected in a closed loop with transistor 71. This creates a very low input impedance of the current amplifier and this input node can be considered as a virtual ground as a result. Thus the current through the input capacitor 70 is determined only by the input signal and the capacitance value of the capacitor 70. The input current passing through the capacitor 70 can pass only through the transistors of the input/reference current path because the other paths are cut off by the constant current sources 75 and 76. Thus the current of the output/mirror current path is proportional to the input current. The current gain of the amplifier is constituted by the ratio of transistors 73 and 74.

Figure 8:
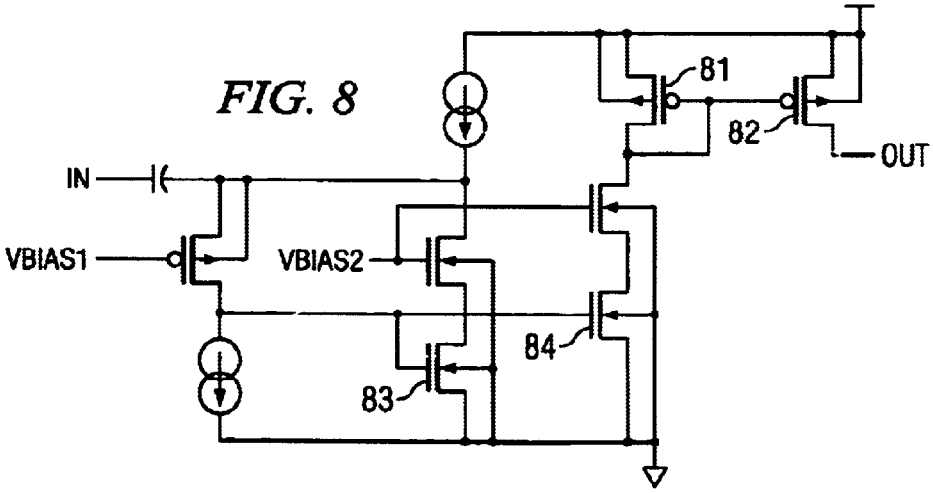
FIG. 8 is a schematic of the noninverting current amplifier of FIG. 5 according to an exemplary embodiment of the present invention.

An implementation of a noninverting current amplifier that may be utilized in the current mirror of FIG. 5 is shown in FIG. 8. An additional current mirror composed of transistors 81 and 82 is included into the current amplifier for an additional inversion stage. The gain of the current amplifier of FIG. 8 can be constituted both by the ratio of transistors 83 and 84 and by the ratio of the transistors 81 and 82.

It is understood that the current mirror based current amplifiers of FIGS. 7 and 8 have their own nonlinear distortions. However, these current amplifiers are dealing with relatively small signals. Therefore, the current amplifiers can introduce additional distortions to the current mirrors of only a second order of magnitude, while canceling distortions in the current mirrors of the first order of magnitude therein.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A current mirror, comprising:

a reference branch including a first transistor having first and second conduction terminals and a control terminal, the reference branch operating to have a first current pass through the first transistor;

a mirror branch including a second transistor having first and second conduction terminals and a control terminal coupled to the control terminal of the first transistor, the second terminal of the first transistor and the second terminal of the second transistor being coupled together, the mirror branch operating to have a second current pass through the second transistor that is proportional to the first current;

a capacitor having a first terminal coupled to the reference branch and a second terminal; and a current amplifier having an input coupled to the second terminal of the capacitor, the current amplifier operating to provide an output current to a transistor conduction terminal in one of the reference branch and the mirror branch.

2. The current mirror of claim 1, wherein a capacitance value of the capacitor and a gain of the current amplifier are set so as to provide a current to the reference branch that is substantially the same as current passing through a parasitic capacitance coupled to the control terminals of the first and second transistors.

3. The current mirror of claim 1, wherein a capacitance value of the capacitor and a gain of the current amplifier are set so as to provide a current to the mirror branch which substantially compensates for current passing through a parasitic capacitance corresponding to the control terminals of the first and second transistors.

4. The current mirror of claim 1, wherein the current amplifier is an inverting amplifier having a negative gain.

5. The current mirror of claim 1, wherein the current amplifier is a non-inverting amplifier having a positive gain.

6. The current mirror of claim 1, wherein the first and second transistors comprise field effect transistors.

7. The current mirror of claim 1, wherein the capacitor is a field effect transistor.

8. A current mirror, comprising:

a reference branch including a first transistor having first and second conduction terminals and a control terminal, the reference branch operating to have a first current pass through the first transistor;

a mirror branch including a second transistor having first and second conduction terminals and a control terminal coupled to the control terminal of the first transistor, the second terminal of the first transistor and the second terminal of the second transistor being coupled together, the mirror branch operating to have a second current pass through the second transistor that is proportional to the first current;

a capacitor having a first terminal coupled to the reference branch and a second terminal; and a current amplifier having an input coupled to the second terminal of the capacitor, the current amplifier operating to provide the output current to the control terminal of the first transistor in the reference branch.

9. The current mirror of claim 8, wherein the reference branch further comprises a third transistor having a first conduction terminal coupled to an input of the current mirror and the control terminals of the first and second transistors, a second conduction terminal coupled to the first conduction terminal of the first transistor and a control terminal coupled to a voltage reference, and an output of the current amplifier is coupled to the control terminals of the first and second transistors and the first conduction terminal of the third transistor.

10. A current mirror, comprising:

a reference branch including a first transistor having first and second conduction terminals and a control terminal, the reference branch operating to have a first current pass through the first transistor;

a mirror branch including a second transistor having first and second conduction terminals and a control terminal coupled to the control terminal of the first transistor, the second terminal of the first transistor and the second terminal of the second transistor being coupled together, the mirror branch operating to have a second current pass through the second transistor that is proportional to the first current;

a capacitor having a first terminal coupled to the reference branch and a second terminal; and a current amplifier having an input coupled to the second terminal of the capacitor, the current amplifier operating to provide the output current to the mirror branch.

11. The current mirror of claim 10, wherein the mirror branch further comprises a third transistor having a first conduction terminal coupled to an output of the current mirror, a second conduction terminal coupled to the first conduction terminal of the second transistor, and a control terminal, and an output of the current amplifier is coupled to the second terminal of the third transistor.

12. A current mirror circuit, comprising:

a first current mirror, comprising:

a reference branch having a first current;

a mirror branch coupled to the reference branch and having a second current proportional to the first current of the reference branch; and an amplifier having an input coupled to the reference branch of the first current mirror and an output; and a second current mirror, comprising:

a reference branch having a third current;

a mirror branch coupled to the reference branch of the second current mirror and having a fourth current proportional to the third current; and an amplifier having an input coupled to the reference branch of the second current mirror and an output coupled to the first current mirror so as to substantially compensate for current passing through at least one parasitic capacitance of the second current mirror;

the output of the amplifier of the first current mirror is coupled to the second current mirror so as to substantially compensate for current passing through at least one parasitic capacitance of the first current mirror.

13. The current mirror circuit of claim 12, wherein the output of the amplifier of the first current mirror is coupled to the mirror branch of the second current mirror.

14. The current mirror circuit of claim 13, wherein the output of the amplifier of the second current mirror is coupled to the mirror branch of the first current mirror.

15. The current mirror circuit of claim 13, wherein the output of the amplifier of the first current mirror is coupled to the reference branch of the second current mirror.

16. The current mirror circuit of claim 15, wherein the output of the amplifier of the second current mirror is coupled to the reference branch of the first current mirror.

17. The current mirror circuit of claim 12, wherein the first current mirror further comprises a capacitor coupled between the input of the amplifier of the first current mirror and the reference branch thereof.

18. The current mirror circuit of claim 17, wherein a capacitance value of the capacitor of the first current mirror and a gain of the amplifier of the first current mirror are chosen so that the current provided to the second current mirror by the amplifier of the first current mirror within a predetermined frequency range is substantially proportional to current passing through a parasitic capacitance coupled to an input of the first current mirror.

19. The current mirror circuit of claim 17, wherein the second current mirror further comprises a capacitor coupled between the input of the amplifier of the second current mirror and the reference branch thereof.

20. The current mirror circuit of claim 12, wherein the current amplifier of the first current mirror is an inverting amplifier having a negative gain.

21. The current mirror of claim 12, wherein the current amplifier of the first current mirror is a non-inverting amplifier having a positive gain.

22. The current mirror circuit of claim 12, the first and second current mirrors comprise field effect transistors.

23. A method of mirroring current in a current mirror having a reference branch and at least one mirror branch, comprising passing a first current through conduction terminals of transistors in the reference branch;

passing a second current through conduction terminals of transistors in the at least one mirror branch that is proportional to the first current; and providing a compensation current to a conduction terminal in at least one of the reference branch and the at least one mirror branch to compensate for current passing through a parasitic capacitance associated with the current mirror.

24. The method of claim 23, wherein the compensation current is provided by a current amplifier coupled to the reference branch of the current mirror by a capacitor.

25. A method of mirroring current in a current mirror having a reference branch and at least one mirror branch, comprising passing a first current through transistors in the reference branch;

passing a second current through transistors in the at least one mirror branch that is proportional to the first current, at least one transistor in the reference branch and one transistor in the mirror branch sharing a common control terminal; and providing a compensation current to the common control terminal in the reference branch of the current mirror to compensate for current passing through a parasitic capacitance associated with the current mirror.

26. A method of mirroring current in a current mirror having a reference branch and at least one mirror branch, comprising passing a first current through transistors in the reference branch;

passing a second current through transistors in the at least one mirror branch that is proportional to the first current; and providing the compensation current to the at least one mirror branch of the current mirror to compensate for current passing through a parasitic capacitance associated with the current mirror.

27. A current mirror, comprising:

a reference branch including a first transistor having first and second conduction terminals through which a first current passes and a control terminal;

a mirror branch including a second transistor having first and second conduction terminals through which a second current passes that is proportional to the first current and a control terminal coupled to the control terminal of the first transistor;

a capacitor having a first terminal coupled to the reference branch and a second terminal; and a current amplifier receiving a single input current from the second terminal of the capacitor, the current amplifier operating to amplify the single input current and output a compensation current that is applied to one of the reference branch and the mirror branch.

28. The current mirror of claim 27, wherein the compensation current output from the current amplifier is applied to the control terminals of the first and second transistors.

29. The current mirror of claim 27, wherein the compensation current has a value which substantially compensates for a current passing through a parasitic capacitance associated with the control terminals of the first and second transistors.

30. The current mirror of claim 27, wherein the compensation current output from the current amplifier is applied to a conduction terminal of one transistor in the one of the reference branch and mirror branch.

31. The current mirror of claim 27, wherein the current amplifier is an inverting amplifier having a negative gain.

32. The current mirror of claim 27, wherein the current amplifier is a non-inverting amplifier having a positive gain.

* * * * *